US005651381A

United States Patent [19]

Balouchian

[11] Patent Number: 5,651,381

[45] Date of Patent: Jul. 29, 1997

[54] CLEANING APPARATUS FOR PAINT ROLLER APPLICATOR

[76] Inventor: Hossein Balouchian, P.O. Box 32631, Oklahoma City, Okla. 73123

[21] Appl. No.: 560,802

[22] Filed: Nov. 21, 1995

[51] Int. Cl.[6] ..... B08B 3/02

[52] U.S. Cl. ..... 134/138; 134/183; 134/900; 134/175; 134/177; 239/752

[58] Field of Search ..... 134/177, 182, 134/183, 900, 200, 138, 175; 239/231, 239, 242, 264, 752

[56] References Cited

U.S. PATENT DOCUMENTS

| | | | |
|---|---|---|---|
| 2,038,803 | 4/1936 | Olson | 134/177 |
| 2,121,866 | 6/1938 | Fredrikson | 134/177 |
| 2,938,368 | 5/1960 | Bixel | 134/900 |
| 3,075,534 | 1/1963 | Habostad | 134/138 |
| 3,422,828 | 1/1969 | Dommer | 134/177 |
| 3,472,251 | 10/1969 | Parker, Jr. | 134/900 |
| 3,732,593 | 5/1973 | Habostad | 134/900 |
| 3,775,840 | 12/1973 | Barger | 15/1 |
| 3,873,364 | 3/1975 | Smith | 134/144 |
| 3,901,256 | 8/1975 | Habostad | 134/900 |
| 4,130,124 | 12/1978 | Sherwin | 134/900 |
| 4,171,094 | 10/1979 | Halfen | 239/752 |
| 4,178,652 | 12/1979 | Adams et al. | 134/144 |
| 4,294,272 | 10/1981 | Klaiber | 134/900 |
| 4,549,562 | 10/1985 | Ossi | 134/138 |
| 4,641,673 | 2/1987 | Conley et al. | 134/138 |
| 4,667,363 | 5/1987 | Calvert | 134/900 |
| 4,700,728 | 10/1987 | Patterson | 134/138 |
| 4,701,242 | 10/1987 | Scarano et al. | 239/752 |
| 4,708,152 | 11/1987 | Hibberd | 134/138 |
| 4,711,258 | 12/1987 | Rossborough et al. | 134/138 |
| 4,735,221 | 4/1988 | Vegiard | 134/138 |
| 4,985,957 | 1/1991 | Belanger et al. | 239/752 |
| 5,005,598 | 4/1991 | Hodgdon | 134/138 |
| 5,337,769 | 8/1994 | Howe | 134/138 |
| 5,402,808 | 4/1995 | Wallis et al. | 134/104.2 |
| 5,409,027 | 4/1995 | Glunt | 134/138 |

*Primary Examiner*—Frankie L. Stinson
*Attorney, Agent, or Firm*—Bill D. McCarthy; Randall K. McCarthy; Philip L. Free, Jr.

[57] ABSTRACT

A cleaning apparatus for a paint roller assembly having a roller applicator, the apparatus having a housing assembly forming a cleaning cavity and forming a longitudinal input slot, support apparatus removably supporting the paint roller assembly to dispose the roller applicator within the cleaning cavity for free rotation about the center axis thereof, and a nozzle and sealing assembly supported on the housing assembly having a nozzle having fluid communication with the cleaning cavity through the input slot and closure assembly which movably supports the nozzle for travel along the length of the input slot, the nozzle attachable to a high pressure supply of cleaning fluid, the nozzle supported to direct cleaning fluid against the roller applicator to impart rotation thereof during cleaning.

8 Claims, 5 Drawing Sheets

CLEANING APPARATUS FOR PAINT ROLLER APPLICATOR

BACKGROUND OF INVENTION

1. Field of Invention

The present invention relates to cleaning devices for painting implements, and more particularly but not by way of limitation, to a cleaning apparatus for a paint roller assembly having a roller cover used for painting surfaces.

2. Discussion

Many paints that are presently available are water based paints that can be diluted or dissolved by water before the paints dry. Such water based paints are frequently applied by the use of the well known paint roller assembly which has a roller applicator and roller cover for the application of the paint. Following the painting job or when terminating the painting process, it is necessary to clean the roller cover such as by washing it with water. This can be achieved by holding the roller cover under a stream of water issuing from a conveniently located faucet or garden hose, but in addition to being quite messy, adequate cleaning of the roller cover of the applicator is difficult to achieve by this technique. That is, this crude cleaning method seldom leads to complete cleaning of the roller cover, and it is often the case that the washed off paint splashes onto surfaces that are left with the residue of the cleaning task.

Prior art cleaning apparatuses that have been made for cleaning paint from roller applicators have been numerous, and have included, for example: U.S. Pat. No. 5,409,027, issued to Glunt, provides a vertically extending cylindrical container having a manifold assembly with a pair of vertically extending spray manifolds. A paint cover to be cleaned must be removed from the paint roller assembly and mounted on a support mechanism that supports the paint cover such that water is jetted both on its external and internal surfaces from a plurality of apertures along the length of each of the two spray manifolds.

Similarly, U.S. Pat. No. 5,337,769 issued to Howe, provides for the support of a paint cover which has been removed from its roller applicator and supported vertically in a cylindrical container. The jetting end of a garden hose is extended through a vertically extending slot in the wall of the container; a flexible sealing flap over the slot permits entry of the hose end while generally sealing the slot. The garden hose can be moved along the slot as the water jetting therefrom cleans the paint form the paint cover.

U.S. Pat. No. 3,873,364, issued to Smith, teaches a paint roller sleeve washer that similarly supports the roller sleeve, or roller cover, on a rotatable spindle and jetting cleaning fluid from a nozzle body is directed thereagainst. The nozzle body is support for reciprocal movement along an open slot in the wall of the container, and an internal baffle partially shields the slot from backsplashing of the cleaning fluid.

Representative of the numerous other devices for cleaning paint roller applicators are the following: U.S. Pat. No. 4,641,673 issued to Conley, et al.; U.S. Pat. No. 3,428,060 issued to Spivey; U.S. Pat. No. 5,402,808 issued to Wallis et al.; U.S. Pat. No. 4,549,562 issued to Ossi; U.S. Pat. No. 2,831,488 issued to Anderson; U.S. Pat. No. 4,809,722 issued to Pennise; U.S. Pat. No. 3,075,534 issued to Habostad; U.S. Pat. No. 4,708,152 issued to Hibberd; U.S. Pat. No. 3,755,840 issued to Barger; U.S. Pat. No. 4,832,066 issued to Shipman; U.S. Pat. No. 4,711,258 issued to Rossborough et al.; and U.S. Pat. No. 4,709,717 issued to Rannigan et al. None of these prior art teachings has provided a completely satisfactory apparatus for cleaning a paint roller applicator.

The present invention provides an improved roller cleaning apparatus which quickly, efficiently and neatly cleans the roller cover of a paint roller applicator for water based paints.

SUMMARY OF THE INVENTION

The present invention provides an improved cleaning apparatus for a paint roller assembly of the type having a roller applicator which supports a roller cover that applies paint during the painting of a selected surface. The present invention comprises a housing apparatus that forms a cleaning cavity; support means for removably supporting the paint roller apparatus so that the roller applicator and roller cover are disposed for free rotation in the cleaning cavity; a nozzle assembly having a nozzle in fluid communication with the cleaning cavity; and a closure means that supports the nozzle for travel along the length of the housing while sealing the cleaning cavity, the cleaning fluid angularly impinging the roller cover to impart rotation during cleaning.

The roller applicator supports the roller cover so that it is cleaned by the full pressure of the cleaning fluid, that is, without reduction in fluid flow therefrom, as the nozzle is caused to travel the length of the roller cover during cleaning. The cleaning fluid, usually water from a garden hose or the like, is totally contained to the cleaning cavity without backsplashing, the housing apparatus having downwardly and rearwardly directed discharge slots to direct the cleaning fluid and paint away from the operator.

An object of the present invention is to provide an improved cleaning apparatus for cleaning the roller cover of a paint roller applicator while confining the cleaning fluid to prevent back splashing and to control fluid discharge.

Another object of the present invention, while achieving the above stated object, is to provide an improved cleaning apparatus for cleaning the roller cover of a paint roller applicator while the roller cover remains mounted on the roller applicator.

Another object of the present invention, while achieving the above stated objects, is to provide a workable cleaning apparatus for the roller cover which is economical to construct, which is easy to operate safely and which is free of mess.

Other objects, advantages and features of the present invention will become apparent from a reading of the following description in conjunction with the drawings and appended claims.

BRIEF DESCRIPTION OF THE DRAWINGS

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

DESCRIPTION

Figure 1:
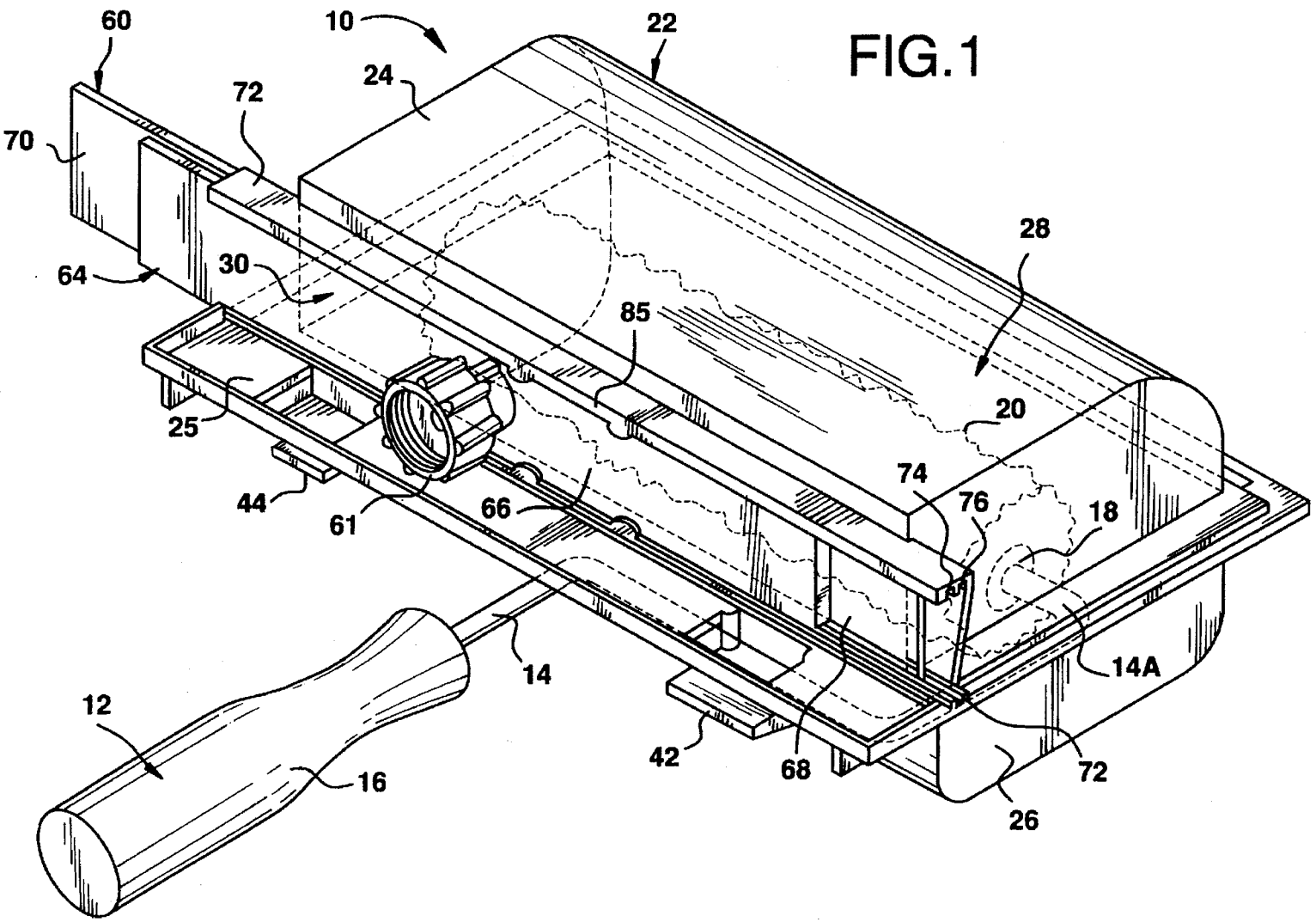
FIG. 1 is a perspective of a roller cleaning apparatus constructed in accordance with the present invention.

Referring to the drawings in general and in particular to FIG. 1, shown therein is a roller cleaning apparatus 10 constructed in accordance with the present invention. It will be understood that numerous details of structure and construction are omitted where such are deemed unnecessary for the purposes of the present disclosure as such details are well within the skill and knowledge of persons skilled in the art. While the present invention is not limited to the materials of construction selected, it will be noted that the embodiment described as the roller cleaning apparatus 10 is well suited for the use of moldable plastics such as polyethylene and the like. Further, in the description that follows like numerals will appear throughout the drawings to indicate the same or identical structure.

The roller cleaning apparatus 10 is depicted in FIG. 1 with a paint roller assembly 12 disposed therein. The paint roller assembly 12 is a conventional painting device which is available at many commercial establishments and probably most hardware and paint stores. The paint roller assembly 12 has a shaft 14 and a grippable handle 16; a rotatable roller applicator 18, attached to the shaft 14, supports a removable roller cover 20.

In use, the person desiring to paint holds the paint roller assembly 12 by the handle 16, and having placed a source of liquid paint in an appropriate container, such as a shallow pan, dips the outer surface of the roller cover 20 in the source of paint so as to pick up some of the paint on the roller cover 20. The painter, holding the handle 16, then positions the roller cover 20 of the paint roller assembly 12 into contact with the surface to be painted and moves the paint roller assembly 12 along such surface so that the roller applicator 18 is caused to rotate, the roller cover 20 thereby depositing a coat of paint on the surface. Once the painting task is terminated, the paint roller assembly 12, including the paint bearing roller cover 20, can be positioned in the roller cleaning apparatus 10 for cleaning in the manner described hereinbelow.

The roller cleaning apparatus 10 has a housing assembly 22 which comprises a top housing 24; a main frame 25; and a bottom housing 26, that together interconnect to form an internal cleaning cavity 28. The top housing 24 has a longitudinal fluid input slot 30 (hidden in FIG. 1 by the closure means described below, but a portion of this slot is shown in the cutaway portion of FIG. 2). The bottom housing 26, also sometimes referred to herein as the drain housing, has several fluid discharge slots 32 (shown in FIG. 5) located at the rear thereof.

Figure 2:
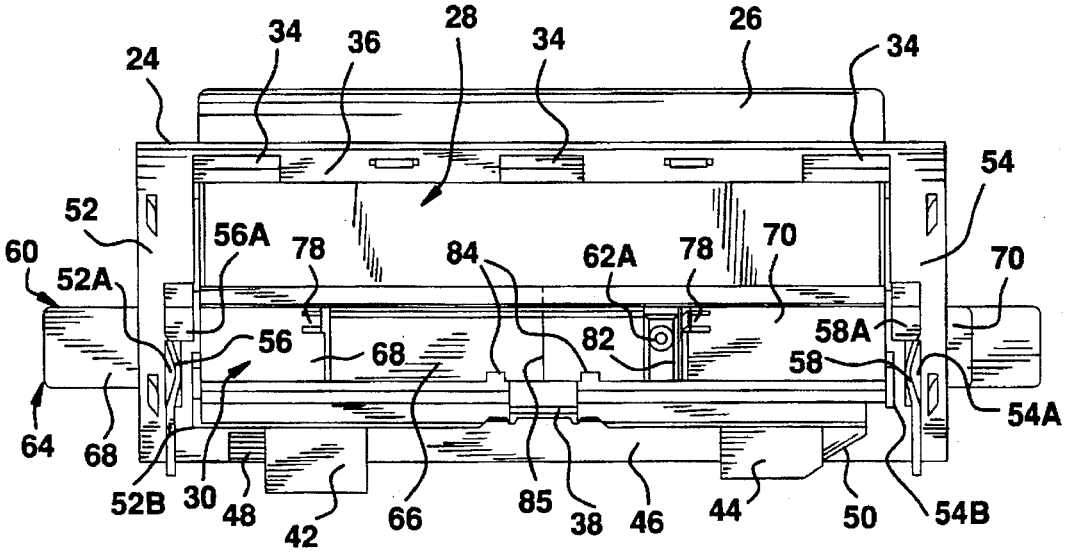
FIG. 2 is a bottom plan view of the top housing of the roller cleaning apparatus of FIG. 1 which is drawn with the roller cleaning apparatus turned at a slight upward tilt to better show the construction details thereof. Additionally, a portion of the closure means is removed to show the slot covered thereby.
Figure 3:
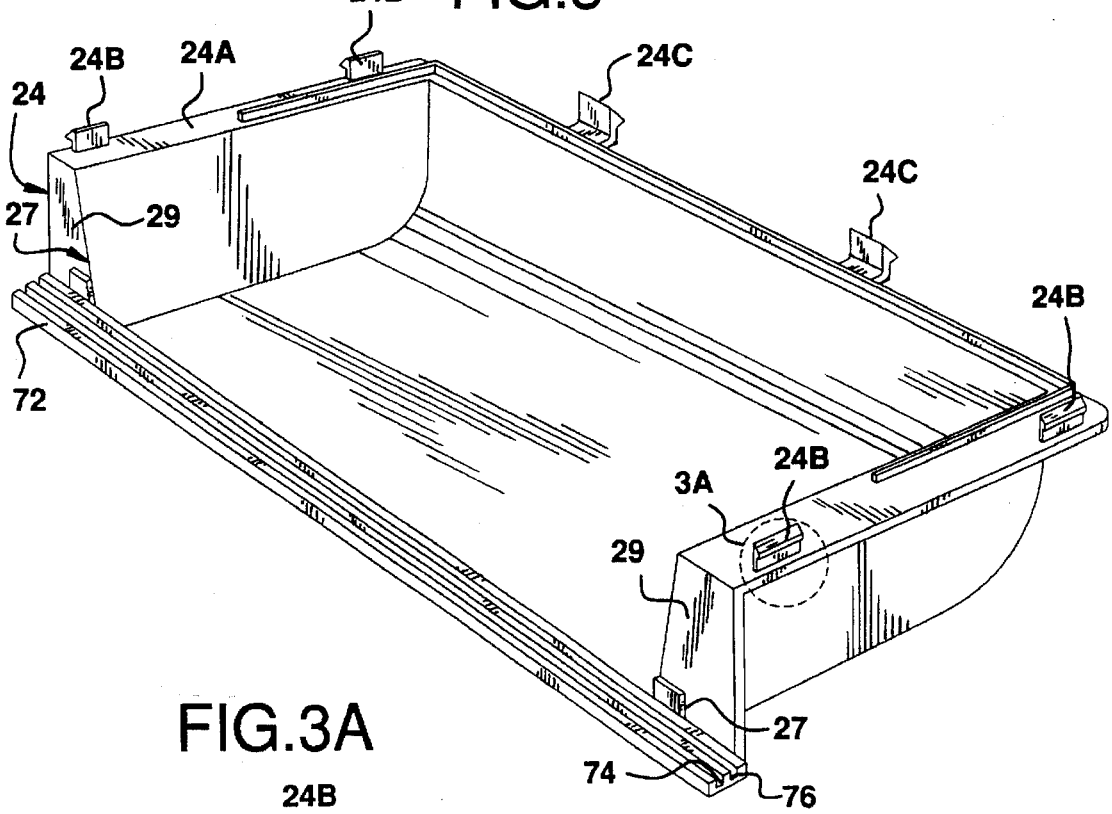
FIG. 3 is a bottom perspective of the top housing of the roller cleaning apparatus of FIG. 1.
Figure 3A:
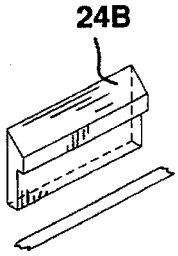
FIG. 3A is an enlarged partial view of the encircled detail enumerated 3A in FIG. 3.

The top and bottom housings 24, 26, together with the main frame 25, are interconnected by the following means to assume the position shown in FIG. 1. FIG. 2, as noted above, is a bottom plan view of the top housing 24 which is shown as slightly tilted upwardly at the rearward portion in order to show the internal details thereof. FIG. 3 shows the top housing 24 alone in an inverted position in order to show the connecting features. Extending around the bottom of the top housing 24 is a skirt 24A, and extending from this skin 24A are several locking tabs 24B; an enlargement of one of the locking tabs 24B is shown in FIG. 3A. Also extending from the skirt 24A are some back locking tabs 24C which are similar in construction insofar as the functional details to the locking tabs 24B.

Figure 4:
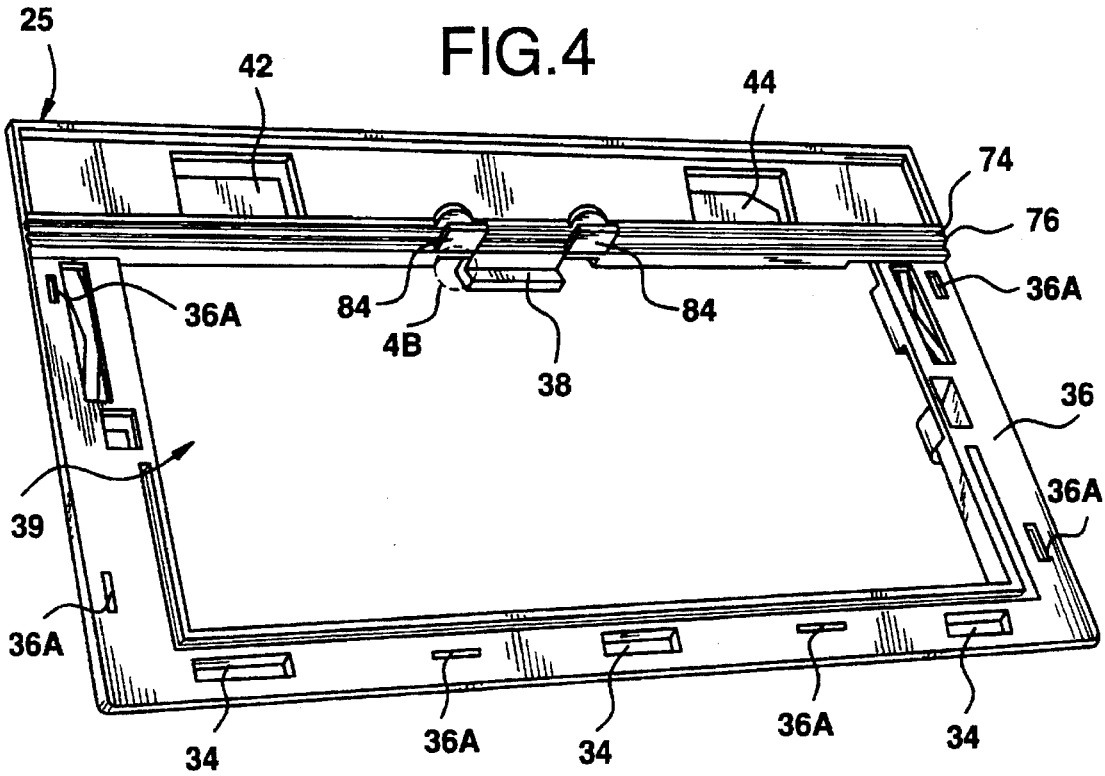
FIG. 4 is a top perspective view of the main frame of the roller cleaning apparatus of FIG. 1.
Figure 4B:
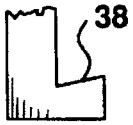
FIG. 4A is a bottom perspective of a portion of the main frame of FIG. 4.
Figure 4A:
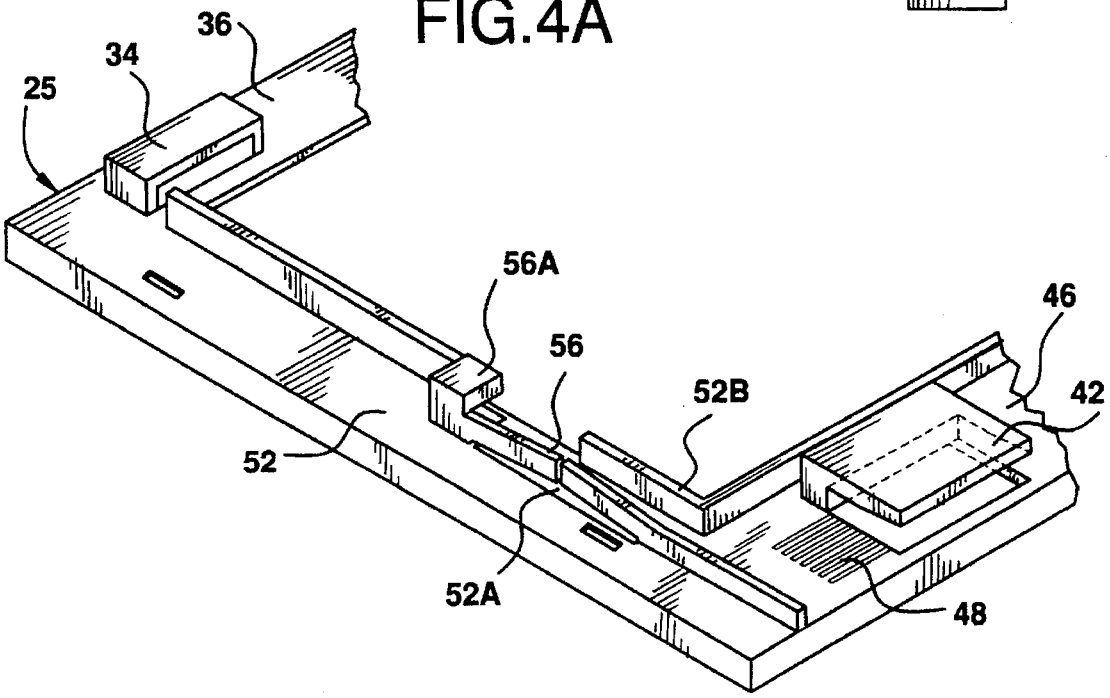

FIGS. 4 and 4A show the main frame 25 as having three tab receiving loops 34 elevated from a planar portion 36 of the main frame 25, and the main frame 25 is provided with a locking lip 38 which extends from a forward portion thereof (shown in enlargement in FIG. 4B). Further, the main frame 25 has several locking tab receiving slots 36A extending through the planar portion 36; these slots 36A are positioned so that the locking tabs 24B and 24C extending from the skin 24A of the top housing 24 will lockingly engage therewith as the top housing 24 is joined to the main frame 25. Each of the locking tabs 24B, 24C is configured to resiliently bend upon entering its respective receiving slot 36A, with each having a retaining lip (as shown in FIG. 3A) which will lock the locking tab in the slot once the retaining lip has passed through the slot. Removal from the slot will be possible only if the resilient locking tab is purposely flexed for removal from the receiving slot.

The main frame 25 forms a central window 39 and the main frame 25 is dimensioned such that the skirt 24A of the top housing 24 abuts the planar portion 36 of the main frame 25 when the top housing 24 is joined to the main frame 25, whereupon the dimensions of the central window 39 are established so that the central window 39 will frame the hollow of the top housing 24. That is, when the top housing 24 is placed against the main frame 25, the protruding locking tabs 24B and 24C are positioned in alignment with the slots 36A, and with a firm pressure applied in pushing these members together, the main frame 25 will be affixed to the bottom of the top housing 24 and secured thereto via the locking tabs 24B and 24C.

Figure 5:
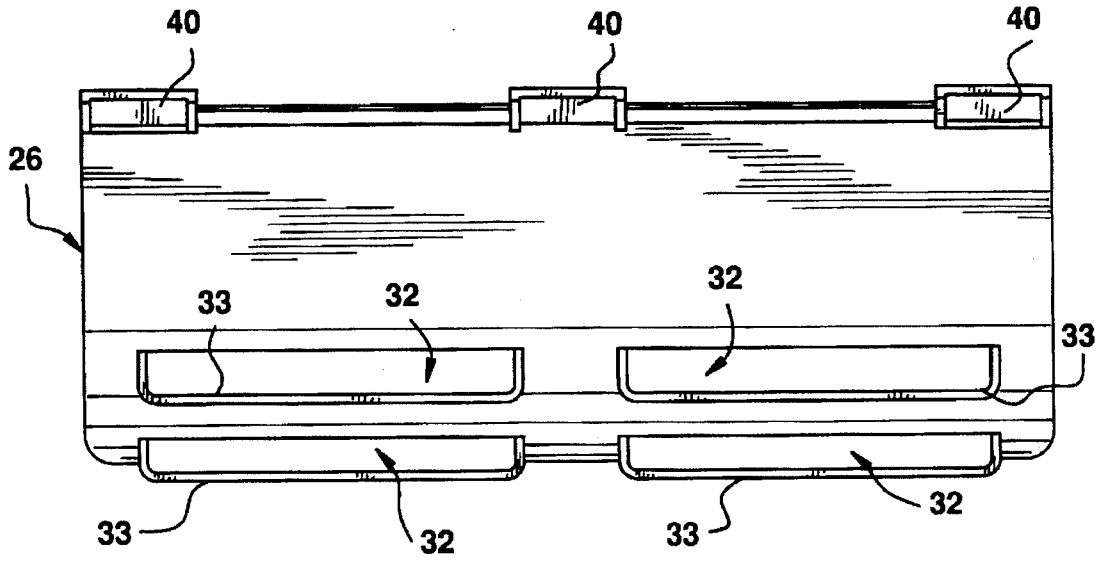
FIG. 5 is a rear elevational view of the bottom housing of the roller cleaning apparatus of FIG. 1; in this view the roller cleaning apparatus is shown turned at a slight upward tilt to better show the construction details thereof.
Figure 5A:
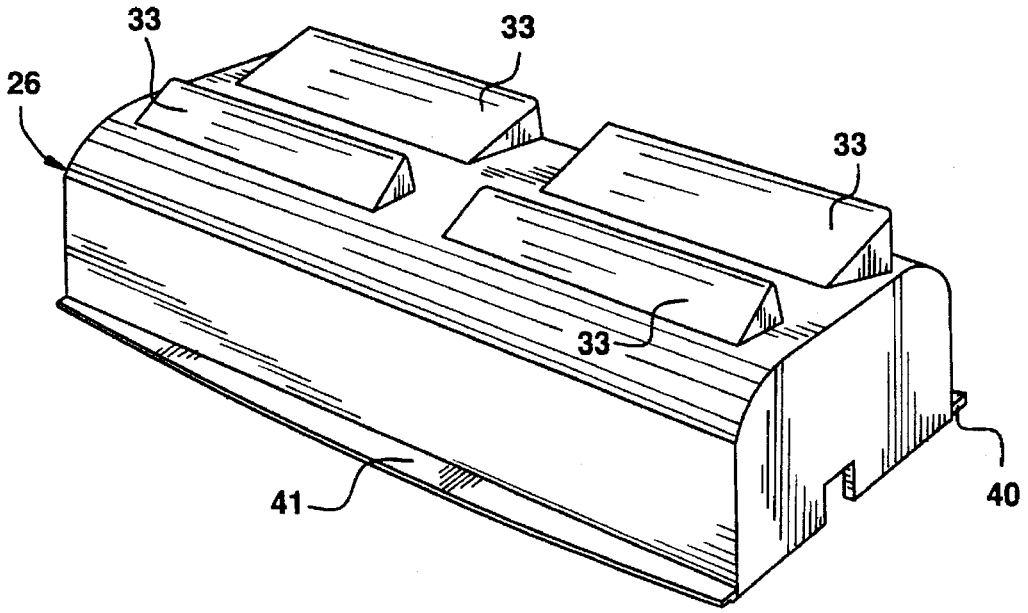
FIG. 5A is a bottom perspective view of the bottom housing shown in FIG. 5.

FIG. 5, as stated above, is a rear elevational view of the bottom housing 26 which is shown with a slight upward tilt of the rearward portion thereof to better show the location of the fluid discharge slots 32. The bottom housing 26 has several external baffle members 33 which cover the fluid discharge slots 32 as shown in FIG. 5A. These baffle members 33 serve to direct the discharged cleaning fluid toward the rear of the roller cleaning apparatus 10 and away from the user thereof during the cleaning process.

As also shown in FIG. 5, the bottom housing 26 is provided with three connecting tabs 40 along its rear portion. These connecting tabs 40 are spaced apart and are disposed to align with and to be received by the tab receiving loops 34 of the main frame 25. The forward portion of the bottom housing 26 has an engaging lip 41 which the locking lip 38 of the main frame 25 latches over upon joinder of the top and bottom housings 24, 26 and main frame 25 to form the cleaning cavity 28. That is, once the main frame 25 and the top housing 24 have been joined as described above, the bottom housing 26 can be joined therewith by causing the connecting tabs 40 to be inserted into the tab receiving loops 34 on the underside of the planar portion 36 of the main frame 25, and as the front portion of the bottom housing 26 is brought into engagement with the main frame 25, the application of a firm pressure thereagainst will cause the locking lip 38 of the main frame 25 to latch over the engaging lip 41 extending from the front of the bottom housing 26.

Returning to FIG. 2, and with continued reference to FIGS. 4 and 4A, shown therein is a first shaft holding tab 42 and a second shaft holding tab 44 which extend from a surface 46 of the planar portion 36 at the underside of the forward portion of the main frame 25. Disposed adjacent to the first shaft holding tab 42 is an area of several friction ribs 48 which are disposed on the surface 46; and disposed adjacent to the second shaft holding tab 44 is an area of several friction ribs 50 which are also disposed on the planar surface 46. The first and second shaft holding tabs 42, 44 are elevated from the surface 46 by different dimensions that are determined to accommodate thicker and thinner shafts commonly found on commercially available paint roller assemblies of the type shown as the paint roller assembly 12. That is, the first and second shaft holding tabs 42, 44 provide sufficient space thereunder such that the placement of an appropriately sized shaft 14 will be secured between the first or second shaft holding tabs 42, 44 and the surface 46 of the main frame 25.

As best shown in FIGS. 2 and 4A, disposed at each end of the main frame 25 are surfaces 52 and 54, respectively. A resilient first side locking detente 56 is provided on the surface 52, and likewise, a resilient second side locking detente 58 is provided on the surface 54. The surfaces 52, 54 are relieved at slots 52A and 54A beneath the first and second side locking detentes 56, 58, respectively, to permit suspension of the resilient portions of these locking detentes. Shoulders 52B and 54B extend from the surfaces 52, 54 as shown, and the dimensions between the shoulder 52B and the first side locking detente 56 and between the shoulder 54B and the second side locking detente 58 are selected to secure the shaft 14 therebetween, these dimensions being predetermined to accommodate different shaft diameters. The first side locking detente 56 has an overhang portion 56A and the second side locking detente 58 has an overhang portion 58A which serves to enhance the gripping ability of the first and second side locking detentes 56, 58 when the shaft 14 is secured thereby. That is, the shaft 14 has a bend portion 14A which is received in either the overhang portion 56A or the overhang portion 58A.

With the bottom housing 26 removed from the main frame 25, the paint roller assembly 12 shown in FIG. 1 has been mounted onto the top housing 24 by pressing the neck of the shaft 14 between the first shaft holding tab 42 and the planar surface 46, the friction ribs 48 serving to resist movement of the shaft 14 beneath the first shaft holding tab 42. With the paint roller assembly 12 in this position, having the neck of the shaft 14 secured by the first shaft holding tab 42, another portion of the shaft 14 is disposed to be gripped between the first side locking detente 56 and the shoulder 52B (and the overhang portion 56A); the roller applicator 18 with its roller cover 20 is now disposed securely within the cleaning cavity 28. With the paint roller assembly 12 thus mounted, the bottom housing 26 is then assembled to the main frame 25 in the manner described above to completely enclose the roller cover 20 within the cleaning cavity 28.

The mounting of the paint roller assembly 12 has just been described with regard to its placement into the roller cleaning apparatus 10 with engagement of the first shaft holding tab 42 and the first side locking detente 56, thus illustrating one of the two possible placements of the paint roller assembly 12. For different sizes of paint roller assemblies 12, having different thicknesses of the shaft 14, the paint roller assembly 12 can be mounted to be gripped by the second shaft holding tab 44 and the second side locking detente 58. Either of these options disposes the roller cover 20 in suspension in the cleaning cavity 28 and thus free to rotate with the washing thereof as described further below.

Continuing with the description of the structural construction of the roller cleaning apparatus 10 with reference to FIG. 2, it has been mentioned that the fluid input slot 30 extends between the forward portion of the top housing 24 and the main frame 25. This fluid input slot 30 is provided for the jetting of the cleaning fluid, usually water, into the cleaning cavity 28 for impingement against the roller cover 20 preferably in a manner which causes rotation thereof during the cleaning process and which prevents backsplashing of the washing fluid. That is, the input slot 30 must permit entry of the cleaning fluid while simultaneously the input slot 30 must be substantially sealed to prevent backsplashing therethrough.

Figure 6:
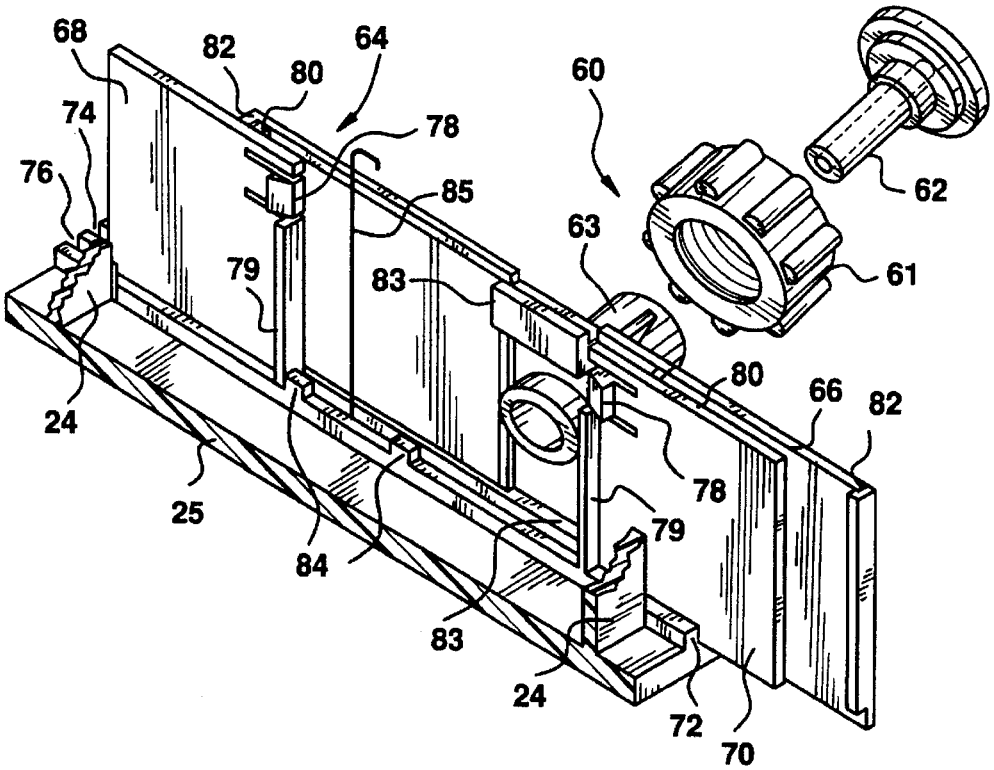
FIG. 6 is a perspective view of the nozzle and sealing assembly of the roller cleaning apparatus of FIG. 1 with only a portion of the main frame shown.
Figure 6A:
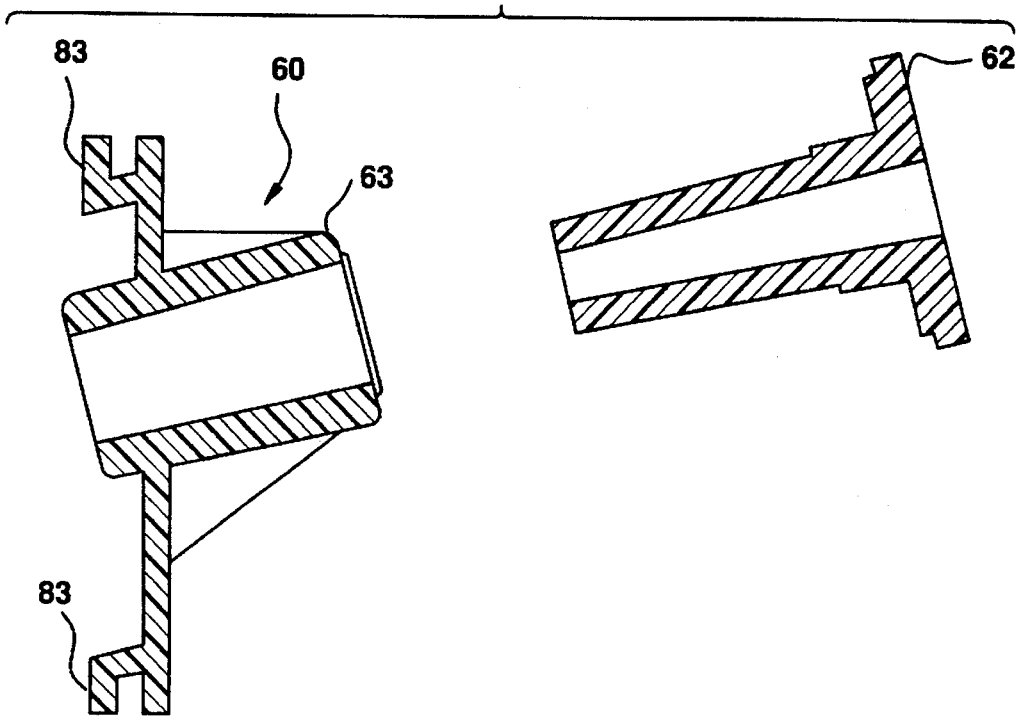
FIG. 6A is a cross sectional view taken through the nozzle support member and the nozzle, depicting the axial alignment thereof.

This is achieved by a nozzle and sealing assembly 60 supported on the housing assembly 22 between the top housing 24 and the main frame 25, as best shown in FIGS. 1, 2 and 6. The nozzle and sealing assembly 60 has a threaded female connector 61 and a nozzle 62 which together form a connector of the type that fits over the threaded male end of a garden hose. A nozzle support member 63 having a bore therethrough is provided for supporting the nozzle 62; the nozzle 62 is pressed into this bore and bonded (such as by ultrasonic welding) to the nozzle support member 63. An elastomeric gasket (not shown) may be provided if required to achieve adequate sealing of the hose end in the connector 61. The nozzle 62 is supported for fluid communication with the fluid input slot 30 so that jetted cleaning fluid, preferably water from a garden hose (not shown), will pass through the fluid input slot 30 and impinge on the roller cover 20 within the cleaning cavity 28.

The nozzle and sealing assembly 60 further has a closure means 64 for slidably supporting the nozzle 62 for travel along the length of the fluid input slot 30, the closure means 64 also substantially sealing the fluid input slot 30 along the length thereof with the exception of the fluid communication to the cleaning cavity provided by the nozzle 62. The closure means 64 comprises a longitudinally extending central sealing member 66, a first side sealing member 68 and a second side sealing member 70 that are caused to interact and appropriately overlap to cover the fluid input slot 30 along its entire length throughout the travel of the nozzle 62.

The closure means 64 further comprises a pair of spaced apart track members 72 supported by the top housing 24 and the main frame 25 on either longitudinal side of the fluid input slot 30. The track members 72 provide an outboard first pair of parallel grooves 74 in which the central sealing member 66 is slidingly supported, and an inboard a second pair of parallel grooves 76 in which the first side sealing member 68 and the second side sealing member 70 are supported for sliding along the length of the fluid input slot 30. With the appropriately positioned stop members, to be described, the two side sealing members—the first and second side sealing members 68, 70—are always caused to extend as required to augment the central sealing member 66 in its function to sealingly cover the fluid input slot 30.

As shown in FIGS. 2 and 6, each of the first and second side sealing members 68, 70 has a locking tab 78 which comprises a depressible tab separated along its sides from the supporting sealing member and having a protruding lip which, when depressed, permits removal or mounting of the supporting sealing member in the second pair of parallel grooves 76. In the rest position the locking tabs 78, the protruding lips abut the projections 27 on front wall 29 of the top housing 24 to retain the sealing members 68, 70 within the inboard second pair of parallel grooves 76 while permitting one of the sealing members 68, 70 to extend fully when pushed to either end of the supporting track members. Also, each of the first and second side sealing members 68, 70 has a protruding ledge 80 on the opposite side to that of the protruding lip of the locking tab 78 at a distance removed from the end of the side sealing member supporting the locking tab. Further, each end of the central sealing member 66 has a protruding ledge 82, and the protruding ledges 80 of the first and second side sealing members 68, 70 are abutted by the protruding ledges 82 of the central sealing member 66 to pull the side sealing members 68, 70 along with the central sealing member 66 in its travel in the track members 72. That is, in each direction of movement of the central sealing member 66 in the outboard grooves 74, one of the first and second side sealing members will be pulled along with the central sealing member 66 whereby the effective length of the central sealing member 66 is extended to always cover the entire length of the input slot 30 regardless of the location of the central sealing member 66. To aid in retaining the central sealing member 66 within the outboard grooves 74, a pair of groove tabs 83 are provided at the midpoint of the central sealing member 66 as shown best in FIG. 6; these groove tabs 83 ride in the inboard grooves 76 of the main frame 25 and the top housing 24. Also, at the midpoint of the input slot 30 a wire stabilizer 85, preferrably made of non-rusting stainless steel, is caused to pass through appropriated disposed and dimensioned, aligned holes in the top housing 24 and the main frame 25, preferrably having a hook portion on one end and, once installed, twisted on the other end to extend across the input slot 30 as shown to prevent the flexing of the plastic materials near the middle of the input slot 30, thus preventing inadvertent removal of the slidable central sealing member 66 from the outboard grooves 74.

With the locking tabs 78 depressed, the first and second side sealing members 68, 70 can be mounted in the second pair of parallel grooves 76. The main frame 25 has stop members 84 which extend into the paths of travel of the first and second side sealing members 68, 70. Also, the ends of the first and second side sealing members 68, 70 have protruding ledges 79 disposed below the locking tabs 78 so that the locking ledges 70 abut against the stop members 84. This restricts the inward travel of the side sealing members 68, 70 between the ends of the fluid input slot 30 and the stop members 84. In like manner, once the first and second side sealing members 68, 70 are slidingly disposed in the second pair of parallel grooves 76, the locking tabs 78 assume their rest positions so that the protrusions 27 of the top housing 24 serve to stop outward travel of the first and second side sealing members 68, 70 as the extending locking tabs 78 are caused to abut thereagainst.

The nozzle 62 is supported by the nozzle support member 63 on the central sealing member 66 for travel along the length of the fluid input slot 30 as the central sealing member 66 is caused to move in the outboard first pair of parallel grooves 74. The nozzle support member 63 is established at an angle off normal that is predetermined to cause the cleaning fluid jetted from the nozzle 62 to impinge the roller cover 20 off center to the axis of rotation of the roller applicator 18 such that the impingement of the cleaning fluid will cause the roller applicator 18 and the supported roller cover 20 to rotate during the cleaning process.

One other feature of the top housing 24 should be mentioned prior to describing the operation of the roller cleaning apparatus 10. The drawings show that the shape of the second shaft holding tab 44 is shaped somewhat different than that of the first shaft holding tab 42. More specifically, one outer edge of the second shaft holding tab 44 is tapered, and the adjacent friction ribs are disposed at an angle which matches the taper of the outer edge of the second shaft holding tab 44. The purpose of this is to accommodate the different angular shapes of the shafts 14 that are commercially available.

In use, the roller cleaning apparatus 10 is connected to a garden hose or any other convenient source of liquid pressure supply line. The paint roller assembly 12 to be cleaned is mounted to the main frame 25 in the manner described above so that the roller cover to be cleaned is disposed for free rotation within the cleaning cavity 28. The bottom housing 26 is then mounted to the main frame 25 as described above, and disposing the roller cleaning apparatus 10 in any convenient position, the cleaning fluid pressure is turned on. The cleaning fluid will usually be water from a garden hose, and while steadying the roller cleaning apparatus 10 with one hand, the hose can be moved side to side to move the nozzle 62 and its supporting central sealing member 66 back and forth in the outboard grooves 74. This causes the pressurized water to impinge against and rotate the roller cover 20. The cleaning water is confined in the cleaning cavity 28 to be discharged only by the fluid discharge slots 32, thereby preventing splashing or other messy conditions. The discharged water can be caught in any convenient fashion for proper disposal.

It will be appreciated that the present invention provides means for cleaning the roller cover of a paint roller applicator without having to remove the roller cover from the paint roller applicator. Further, the present invention provides an apparatus in which the full pressure of the jetting cleaning fluid is impinged directly onto the roller cover, thus providing maximum cleaning potential for the cleaning fluid used. Also, backsplashing of the cleaning fluid is eliminated, and the discharged cleaning fluid and paint can be safely and easily directed to an appropriate discharge receptacle without mess to the operator. The invention can be easily and economically manufactured and thus marketed at a reasonable price.

It is thus clear that the present invention is well adapted to carry out the objects and to attain the ends and advantages mentioned as well as those inherent therein. While a presently preferred embodiment of the invention has been described for purposes of the disclosure, numerous changes may be made which will readily suggest themselves to those skilled in the art and which are encompassed within the spirit of the invention disclosed and as defined in the appended claims.

What is claimed is:

1. A cleaning apparatus for a paint roller assembly having a roller applicator, comprising:

a housing assembly comprising:

a top housing having a longitudinal input slot;

a bottom housing having at least one discharge slot; and means for interconnecting the top and bottom housings of the housing assembly to form a cleaning cavity therebetween, the longitudinal input slot having fluid communication with the housing cleaning cavity;

support means for removably supporting the paint roller assembly to dispose the roller applicator within the cleaning cavity for free rotation about its center axis; and a nozzle and sealing assembly supported on the housing assembly, comprising:

a nozzle having fluid communication through the longitudinal input slot with the cleaning cavity of the housing assembly the nozzle disposed for travel along the longitudinal input slot; and closure means for slidably supporting the nozzle for travel along the longitudinal input slot and for completely sealing the longitudinal input slot during travel of the nozzle along the longitudinal input slot.

2. The cleaning apparatus of claim 1 wherein the nozzle is connectable to the discharge end of a liquid pressure supply line, the nozzle disposed on the housing assembly to direct a jet of cleaning liquid from the supply line against the roller applicator in the cleaning cavity.

3. The cleaning apparatus of claim 2 wherein the jet of cleaning liquid is directed to effect rotation of the roller applicator.

4. The cleaning apparatus of claim 3 wherein the closure means comprises:

track members supported by the top housing and having an outboard pair of parallel grooves disposed on either side of the longitudinal input slot; and a longitudinally extending central sealing member supported in the outboard pair of parallel grooves for sliding movement therein, the nozzle supported by the central sealing member so that the nozzle is movable therewith along the longitudinal input slot.

5. A cleaning apparatus for a paint roller assembly having a roller applicator, comprising:

a housing assembly comprising:

a top housing having a longitudinal input slot;

a bottom housing having at least one discharge slot; and means for interconnecting the top and bottom housings of the housing assembly to form a cleaning cavity therebetween, the longitudinal input slot having fluid communication with the housing cleaning cavity;

support means for removably supporting the paint roller assembly to dispose the roller applicator within the cleaning cavity for free rotation about its center axis; and a nozzle and sealing assembly supported on the housing assembly, comprising:

a nozzle having fluid communication through the longitudinal input slot with the cleaning cavity of the housing assembly, the nozzle connectable to the discharge end of a liquid pressure supply line and disposed on the housing assembly to direct a jet of cleaning liquid from the supply line against the roller applicator in the cleaning cavity, the jet of cleaning liquid being directed to effect rotation of the roller applicator; and closure means for slidably supporting the nozzle for travel along the longitudinal input slot and for sealing the longitudinal input slot about the nozzle during travel of the nozzle along the longitudinal input slot, the closure means comprising:

track members supported by the top housing and having an outboard pair of parallel grooves disposed on either side of the longitudinal input slot;

and a longitudinally extending central sealing member supported in the outboard pair of parallel grooves for sliding movement therein, the nozzle supported by the central sealing member so that the nozzle is movable therewith along the longitudinal input slot.

6. The cleaning apparatus of claim 5 wherein each of the first and second side connecting means comprises spaced apart stop members.

7. The cleaning apparatus of claim 6 wherein each of the first and second side sealing members has a locking tab engageable with the top housing in a locked position and disengageable with the top housing for removal from the inboard pair of parallel grooves.

8. The cleaning apparatus of claim 7 wherein the central sealing member is retained in the outboard pair of parallel grooves when the first and second side sealing members are locked in the inboard pair of parallel grooves, and wherein the central sealing member is removable from the outboard pair of parallel grooves when either of the first and second side sealing members is removed from the inboard pair of parallel grooves.

* * * * *